US006155468A

United States Patent [19]

Kinnich

[11] Patent Number: 6,155,468

[45] Date of Patent: Dec. 5, 2000

[54] CONCEAL CARRY WEAPONS CLIP

[76] Inventor: Francis L. Kinnich, 236 Kimberly La., Ridgecrest, Calif. 93555

[21] Appl. No.: 09/286,580

[22] Filed: Apr. 5, 1999

[51] Int. Cl.[7] ..... A45F 5/00

[52] U.S. Cl. ..... 224/269; 224/271; 224/912

[58] Field of Search ..... 224/912, 911, 224/269, 271

[56] References Cited

U.S. PATENT DOCUMENTS 2,320,450 6/1943 Valenzuela ..... 224/271

5,107,612 4/1992 Bechtel ..... 42/103

5,630,535 5/1997 Valenti ..... 224/912

*Primary Examiner*—Stephen K. Cronin

*Attorney, Agent, or Firm*—Kenneth G. Pritchard

[57] ABSTRACT

A carry clip for a semiautomatic pistol, such as a .45 caliber, is attached to the slide stop of the weapon. The clip is kept small so it does not effect the bulk, weight or balance of the weapon. The clip may be rounded to avoid digging into material it is clipped over. The interior surface may be flat or rounded to provide a snug fit.

1 Claim, 1 Drawing Sheet

CONCEAL CARRY WEAPONS CLIP

BACKGROUND OF THE INVENTION

There are numerous situations where a person needs or desires to carry a concealed weapon. To safely carry such a weapon, normally a pistol if a firearm is the weapon of choice, shoulder holsters, belt holsters and so forth have been used for a long time. Such devices require planning and take time to properly put on and adjust. There have been no devices which are part of the weapon which permit a concealed carry. Of course one can always place the weapon in a pocket but this entails fumbling for the weapon in an emergency.

Putting a device on a pistol raises concerns about significantly increasing the weight, bulk, and balance of such a modified weapon. The object of the present invention is to design a clip suitable for semiautomatic pistols which permits it to be carried concealed without effecting the weight, bulk, or balance of the weapon more than a trivial amount.

SUMMARY OF THE INVENTION

A clip is attached to the slide stop or slide release of a semiautomatic pistol. The clip permits the weapon to be worn clipped under the belt and to an edge of material, such as the waist line of a pair of pants or a skirt. The open end of the clip may be rounded to avoid digging into the material. The interior surface of the clip may be flat or rounded to assure a snug grip. The interior surface of the clip may be angled to adjust the position the weapons sits at while carried.

DESCRIPTION OF THE PREFERRED EMBODIMENTS

Figure 1:
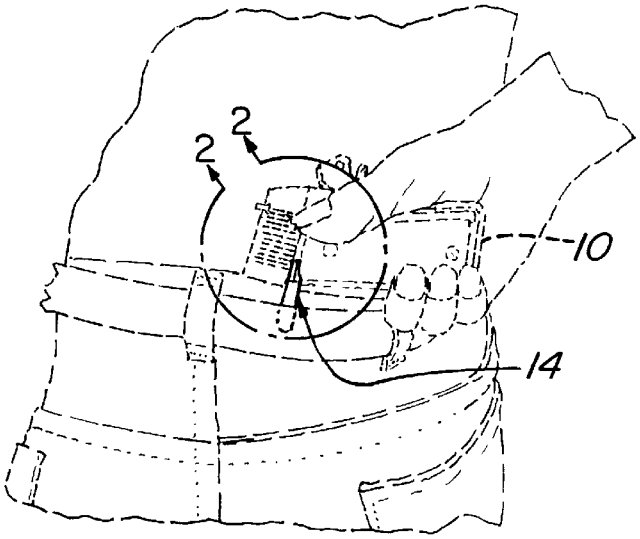
FIG. 1 is a view of the present invention in use.

FIG. 1 shows the present invention used to hold a hand gun inside an article of clothing such as a pair of pants. As shown, the weapon is behind the persons back held by a clip 14.

Figure 2:
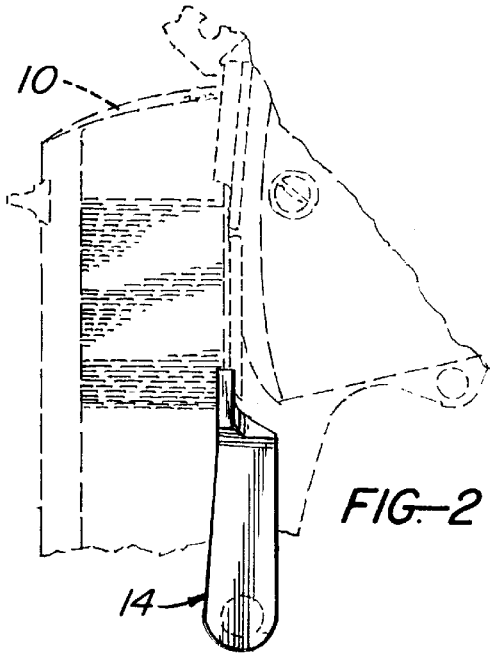
FIG. 2 is a close-up view of FIG 1.

FIG. 2 is a close-uo view of clip 14.

Figure 4:
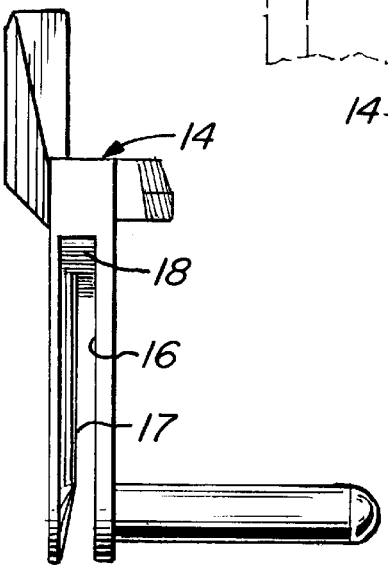
FIG. 4 is a side view of the present invention.

FIG. 4 is a side view of the present invention. A slide stop or slide release 10 for a semiautomatic weapon is shown, such as one suitable for a 0.45 caliber handgun. The terms slide release and slide stop are different terms for the same item. Slide release 10 is a typical slide release for semiautomatic weapons. Above slide release 10, in FIG. 4, a clip 14 is attached to slide release 10. The manner of attachment may be welding and so forth. However, the preferred method of attachment is to form a single piece of carbon steel or stainless steel by precision casting. The addition of clip 14 eliminates the need for a holster. If a person is wearing pants or skirt with a waistband, the weapon may be inserted inside the waistband and kept in place by placing clip 14 over the material of the waistband and under a belt if a belt is worn by the wearer.

As shown in FIG. 4, as clip 14 is shown, it has a square cut on the open end and is attached at the other end to slide stop 10. There is an interior surface 16 which is shown flat in FIG. 4. Where interior surface 16 is blocked off due to the attachment between slide stop 10 and clip 14, an angled surface 18 is shown. While a square cut 90° junction may be made the angled junction shown prevents the weapon from riding straight up and down on a waistband. By riding at an angle, the weapon is accessed with an easier and smoother motion by the wearer.

Figure 3:
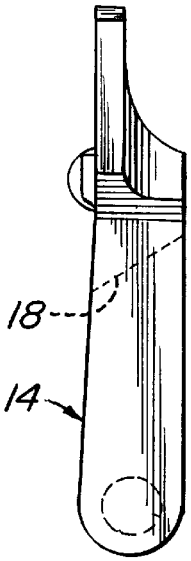
FIG. 3 is a top view of the invention.

FIG. 3 is a top view of clip 14 that shows how angled surface 18 effects the tilt of the weapon when worn.

Figure 5:
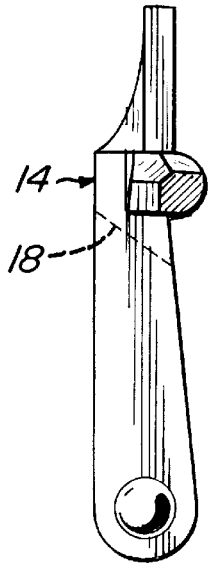
FIG. 5 is a bottom view of the invention.

FIG. 5 is a bottom view of slide stop 10.

Figure 6:
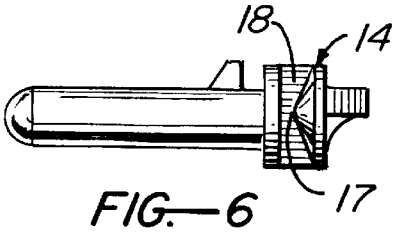
FIG. 6 is an end-on view of the invention.

FIG. 6 is an end-on view from the open end of clip 14. FIG. 4 also shows a different variation of the invention. Interior surface 17 which may be flat is shown rounded which permits a snugger fit on a waistband. The phrase rounded does not require a specific shape. It refers to providing an access which is larger than the portion that provides the snuggest fit.

FIG. 3 is a top view of the invention. FIG. 3 shows yet another embodiment of the present invention. Clip 14 is now shown with a rounded edge or curved cut edge instead of the previously mentioned square cut for the open end. A square cut, results in a point which digs into the material that is to be within the clip. A curved surface has no point to dig into the material.

Clip 14 is relatively small and light in weight. While it avoids the need for a holster, it will not get in the way of carrying the weapon in a traditional holster.

What is claimed is:

1. An apparatus for carrying a semiautomatic handgun, said semiautomatic handgun having a slide stop comprising:

a. a clip connected to said slide stop such that said clip has (1) a blocked-off end where said clip is connected to said slide stop so as to be connected at an angle, (2) an interior surface which is rounded, and (3) a curved open end.

* * * * *